United States Patent [19]

Wang et al.

[11] Patent Number: 4,518,649

[45] Date of Patent: May 21, 1985

[54] SOIL RELEASING TEXTILES CONTAINING FLUOROCHEMICAL SOIL RELEASE AGENTS AND METHOD FOR PRODUCING SAME

[75] Inventors: Robert C. Wang, Monmouth Junction; Arthur J. Sampson, Belle Mead; Mark M. Persinko, Bridgewater, all of N.J.

[73] Assignee: Chicopee, New Brunswick, N.J.

[21] Appl. No.: 609,259

[22] Filed: May 11, 1984

[51] Int. Cl.[3] ..... B32B 27/00

[52] U.S. Cl. ..... 428/284; 5/482; 5/502; 427/393.4; 428/224; 428/287; 428/290; 428/421; 428/422; 428/913

[58] Field of Search ..... 428/421, 422, 913, 284, 428/287, 290, 224; 5/482, 502; 427/393.4

[56] References Cited

U.S. PATENT DOCUMENTS

| | | | |
|---|---|---|---|
| 3,628,997 | 12/1971 | Elkind et al. | 427/393.4 |
| 3,816,167 | 6/1974 | Schultz et al. | 117/138.8 F |
| 3,816,229 | 6/1974 | Blerbrauber | 161/67 |
| 3,896,035 | 7/1975 | Schultz et al. | 252/8.75 |
| 3,944,527 | 3/1976 | McCown | 260/79.7 |
| 3,950,298 | 4/1976 | McCown et al. | 260/33.6 F |
| 3,987,227 | 10/1976 | Schultz et al. | 428/91 |
| 3,995,085 | 11/1976 | McCown | 428/262 |
| 4,318,956 | 3/1982 | Stevens et al. | 428/265 |
| 4,329,391 | 5/1982 | McAlister | 428/265 |
| 4,330,588 | 5/1982 | Larson et al. | 428/264 |
| 4,355,065 | 10/1982 | De Mott | 428/421 |

FOREIGN PATENT DOCUMENTS

| | | | |
|---|---|---|---|
| 46751 | 4/1981 | Japan | 428/422 |

*Primary Examiner*—James J. Bell
*Attorney, Agent, or Firm*—Leonard Kean

[57] ABSTRACT

A fabric of which at least 10% by weight comprises polyester fibers, which fabric is durably soil releasing on laundering and which is useful for preparing the facing sheets of mattress pads. This fabric is finished with a soil release finish consisting essentially of a cured mixture of a fluorochemical soil release agent, an adhesive binder and a cross-linking agent.

13 Claims, No Drawings

SOIL RELEASING TEXTILES CONTAINING FLUOROCHEMICAL SOIL RELEASE AGENTS AND METHOD FOR PRODUCING SAME

This invention relates to a fabric of which at least 10% by weight comprises polyester fibers, which is durably soil releasing on laundering. This fabric is preferably used to prepare the facing sheets of mattress pads.

BACKGROUND OF THE INVENTION

"Soil release" is a general term used to describe a class of textile finishes which make it possible to release soil from fabrics by ordinary washing and they are especially designed to work on polyester fabrics. The soil release systems do not prevent soil from entering the fabric but they simply allow soil to leave the fabric faster. All soil release systems make the fabric hydrophilic (water accepting) and oleophobic (oil releasing-)—to let water in and to keep oil out. Thus, soil release fabrics tend to resist oil-borne stains and permit water to enter for stain removal under ordinary laundering conditions.

The treatment of various textile fabrics with fluorochemicals to impart water and oil repellency has been known to those in the art for several years. Furthermore, certain fluorochemical polymer emulsions impart soil release properties, particularly to nonwoven materials. Durable soil release properties after repeated laundering cycles are assured by said fluorochemical polymer emulsions when used in connection with nonwoven and other materials which do not contain an adhesive binder thereon. However, in accordance with the present invention, it has been found that if nonwoven materials already containing a binder are treated with a fluorochemical soil release agent alone, it does not impart durable soil release properties to the fabric on repeated laundering cycles and, in fact, a substantial proportion of said soil release properties is lost after only two or three laundering cycles. Nonwoven fabrics which have been known for some time have been made from synthetic fibers such as polyester and polyester/rayon fibers. Generally, these fabrics are produced by forming a web of fibers and applying an adhesive binder to the web to hold the fibers together and provide strength. In some instances a fibrous web is fluid rearranged and then resin binder added to form a useful, coherent nonwoven fabric. In such a process, it has been surprisingly found, in accordance with the present invention, that if a fluorochemical soil release agent is added together with a binder and a cross-linking agent, that durable stain release properties on laundering are imparted to the resulting fabric. In this connection, applicant has achieved a soil release fabric durable through ten laundering cycles. In accordance with the present process there is substantially no chemical reaction between the adhesive binder and the fabric to which it is applied. However, it is believed that chemical bonding takes place between the binder, the cross-linking agent and the soil release agent.

The Schultz et al. U.S. Pat. No. 3,816,167 relates to a process for making a non-cellulosic synthetic fiber textile both soil resistant and durably soil releasing on laundering, comprising treating the textile with a soil release finishing composition consisting essentially of a fluoroaliphatic group containing soil release polymer and a polyalkylene glycol cross-linked in situ by an aldehyde-containing prepolymer. In said Schultz method the fluoroaliphatic soil release agent is actually reacted on the surface of the fibers, with the polyalkylene glycol but no binder is used. In the case of the present invention, on the other hand, a binder is used as well as a cross-linking agent. This provides superior results to those obtained when a cross-linking agent, but no binder is used.

A number of patents have issued directed to methods of assuring soil release from textiles, but none of said patents discloses the present method of incorporating a soil release agent and a cross-linking agent in an adhesive binder prior to application to the textile. A list thereof is as follows: U.S. Pat. No. 3,950,298; U.S. Pat. No. 4,330,588; U.S. Pat. No. 3,944,527; U.S. Pat. No. 3,995,085; U.S. Pat. No. 3,896,035; U.S. Pat. No. 3,987,227; U.S. Pat. No. 4,318,956; U.S. Pat. No. 3,816,229; and U.S. Pat. No. 4,329,391.

The present invention is most preferably used when it is desired to impart good soil release properties to entangle fiber polyester nonwoven fabrics to which an adhesive binder is normally applied to hold the fibers together and to provide strength. It has now been surprisingly found that if a soil release agent and a cross-linking agent are incorporated in the binder, that the resultant fabric is durably soil releasing on laundering. This is surprising in view of the fact that no durably soil releasing properties on laundering are obtained if a fabric, already containing a binder, is post-treated with a soil release agent alone.

SUMMARY OF THE INVENTION

The present invention provides a fabric comprising at least 10% by weight of polyester fibers, said fabric being durably soil releasing on laundering, the fabric having been finished with a soil release finish consisting essentially of a mixture of (A) a fluorochemical soil release agent, (B) an adhesive binder; and (C) a cross-linking agent.

The preferred binder utilized in the present invention consists of an acrylic emulsion. The cross-linking agents of the present invention preferably contain reactive aldehyde sites, and the most preferred cross-linking agent is melamine formaldehyde.

This invention preferably relates to an entangled fiber nonwoven fabric comprising at least 10% by weight of polyester fibers, which is durably soil releasing on laundering, the fabric being finished with a soil release finish consisting essentially of a cured mixture of (A) a soil release agent, (B) an acrylic emulsion adhesive binder, and (C) a cross-linking agent, component (A) varying between 0.2% and 0.6%, component (B) varying between 1% and 15% and component (C) varying between 0.15% and 3.0% of the dry weight of the textile. Preferably, the soil release agent varies between 0.2% and 0.4%, the adhesive binder varies between 6% and 12% and the cross-linking agent varies between 0.2% and 1.0% of the dry weight of the textile. A most preferred fabric is one in which the finish consists essentially of a cured mixture of about 0.3% fluorochemical polymer soil release agent, about 9.7% acrylic binder and about 0.3% melamine formaldehyde, based on the dry weight of the textile.

An important use for the fabric of the present invention is that of one or both of the facing sheets of a mattress pad (in the instance wherein the mattress pad consists of a quilted sheet of a fiber filler covered on both sides with said facing sheets).

The present invention also relates to a process for making a fabric of which at least 10% by weight comprises polyester fibers, durably soil releasing on laundering, comprising treating said fabric with a soil release finishing composition consisting essentially of (A) a fluorochemical soil release agent, (B) an adhesive binder and a cross-linking agent, followed by heating and curing.

A preferred method of making the fabric of the invention comprises (a) forming a layer of overlapping intersecting fibers of which at least 10% by weight comprises polyester fibers; (b) supporting the layer on an apertured support member; (c) directing essentially columnar jets of fluid directly against the surface of the supported layer opposite the apertured support member to rearrange the fibers into a regular repeating pattern of lightly entangled fiber regions; (d) applying an effective amount of an adhesive binder which includes a soil release agent and a cross-linking agent, to said rearranged layer; followed by heating and curing.

Although applicant prefers to utilize, in accordance with the present invention, the nonwoven fabric prepared by fluid rearrangement as described above, nevertheless, a wide range of polyester or polyester blend such as polyester/rayon fabrics, both nonwoven and woven, may be treated in accordance with the present invention.

The fibrous web, utilized for preparing the preferred nonwoven fabric of the invention can be formed in any convenient known manner, as by air-laying or carding. As pointed out above, the web is then lightly entangled by passing the fibrous web under essentially columnar liquid streams while the web is supported on a foraminous forming or patterning member. Apparatus such as the general type disclosed by Evans U.S. Pat. No. 3,485,706, can be employed to carry out the entangling. A typical apparatus used for preparing a nonwoven fabric to be treated in accordance with the present invention employs rows of orifices through which liquid (usually water) is jetted under pressure in the form of essentially columnar jets. A suitable apparatus has seven manifolds, with orifices being spaced such that there are about 30 to 50 orifices per linear inch. The orifices are preferably circular with diameters from 0.005 to 0.007 inch. The traveling fibrous web can be positioned about 1 to 2 inches below the orifices. Using the above described typical apparatus, representative conditions include a liquid pressure of 100 pounds per square inch in the first manifold and 600 pounds per square inch in the remaining six manifolds. The web speed is up to 100 yards per minute for a fibrous web weighing about $\frac{1}{2}$ to $2\frac{1}{2}$ ounces per square yard. After the fibrous web has been lightly entangled it is dried and subsequently bonded by padding the binder (including soil release agent and a cross-linking agent) onto it.

The adhesive binder employed can be any of the aqueous latex binders that are conventionally employed as binders for nonwoven fabrics. Such binders include acrylics, ethylene vinyl acetate copolymers, SBR latex rubbers and the like.

After the binder/soil release agent/cross-linking agent has been applied, the web is dried in the usual fashion as by passing the web over a series of drying cans.

The binder is employed in an effective amount, that is, that amount which will result in a fabric having sufficient strength and cohesiveness for the intended end-use application.

The fibers used to produce the products of the invention are fibers of which at least 10% by weight comprises polyester fibers, the remainder being non-polyester fibers. The fibers may have a denier of from 1 or less up to 15 or more and then may be from short fibers such as $\frac{1}{4}$ inch in length up to as long as continuous filament fibers. However, the preferred fiber is 1.5 denier and 1 9/16 inch in length.

Although a number of different fluorochemical soil release agents may be used in the present process, nevertheless, the preferred agent is a product of Minnesota Mining and Manufacturing designated "Scotchban" Paper Protector FC-829, which is a fluorochemical polymer emulsion designed to impart soil release properties to nonwoven materials.

The binder/soil release/cross-linking agent also optionally includes additional ingredients such as surfactants and anti-foaming agents.

A sample of the fabric of the invention was subjected to ten home launderings in order to determine the extent of soil release in accordance with a standard procedure AATCC 130-1981. The standard soil release; oily stain release method is designed to measure the ability of the fabric to release oily stains during home laundering. In this method, an oily stain on a test specimen is produced by using a weight to force a given amount of the stain into the fabric. The stained fabric is laundered, and the residual stain is reltaed on a scale from 5 to 1 by comparison with a standard soil release replica (the number 5 represents the most effective soil release and number 1 represents the least effective soil release). The procedure in accordance with a slightly modified variation of said standard method is as follows:

A test specimen is placed flat on a single thickness of AATCC textile blotting paper on a smooth horizontal surface. Using a medicine dropper, nine drops of Valvoline 30 weight motor oil are placed in the approximate center of the sample. Drops are placed in three parallel rows of three drops each. The area of stain should be approximately 1 inch$\times$1 inch. The stain in then covered with a 3 inch$\times$3 inch square of glassine paper. A 5 lb. weight is then placed on the glassine paper oveer the stain and the weight is then allowed to remain there for 60 seconds. The weight is then removed and the glassine discarded. The test specimen is then washed within 15 to 60 minutes after staining. The washing procedure is as follows:

The washer is filled to high water level with water at 120°$\pm$5° F. One hundred grams of Tide detergent (8.2% phosphorus) are added to the washer. The test specimens and ballast (which consists of 36$\times$36 hemmed pieces of cotton sheeting) are placed into the washer. The total load should weigh 4$\pm\frac{1}{4}$ pounds. The maximum number of test samples is 30. The wash time is set for 10 minutes and allowed to complete full cycle (wash plus rinses). The test samples are then air dried and read within four hours. The dry samples are placed on poster board and the stain release replica is placed vertically with the replica base touching the poster board. This is then viewed from a distance of 30 inches from the replica. Each stage is rated to the nearest 0.5 rating. The latter rating is then repeated using another rater. The average of six ratings is calculated for each sample to the nearest 0.1.

In order to determine the durability of soil release finishes to home laundering, clean samples are washed a prescribed number of times in an automatic washer. The washing procedure is very similar to that described above in connection with the soil release:oily stain release method, the only differences being the following: only 46 g. of Tide detergent are added to the washer, each cycle. After each cycle the samples are removed from the washer and allowed to air dry a minimum of 15 minutes before the next cycle is commenced. Thereafter the samples are tested for soil release using the above described soil release oily stain release method.

Utilizing the above repeated cycle washing procedure, clean samples of the present fabric were subjected to ten launderings and thereafter the samples were tested for soil release using the soil release:oily stain release method which resulted in ratings of 4 and 4.5, demonstrating excellent soil release. When the Scotchban FC-829 soil release agent alone was applied to a similar textile which already contained a binder, the above laundering procedure resulted in a rating of only 2.5 after 2 washes only. In the product literature accompanying Scotchban, the manufacturer points out that the use of other chemicals in conjuction with Scotchban may decrease treatment effectiveness. Contrary to these teachings, it has been surprisingly found in accordance with the present invention, that the use of a binder and a cross-linking agent including surfactants and anti-foaming agents in conjugation with Scotchban actually increases treatment effectiveness.

The invention will be further illustrated in greater detail by the following specific example.

EXAMPLE 1

A web of 1.5 denier 1 9/16 inch polyester staple fibers weighing 422 grains per square yard is formed using an air-laying machine. The web is placed on a woven belt. The belt is woven with 22 warp filaments per inch and 23 fill filaments. The belt has a 26% open area and has an air permeability of 1200 CFM. The web and belt are passed under 7 manifolds. Each manifold contains 2 rows of 12 orifices per inch running in the transverse direction of the web. Each orifice has a diameter of 0.007 inch. Water is jetted through the orifices onto the web at pressure of 100 pounds per square inch gauge through the first manifold and at 600 psig through each of the remaining manifolds to lightly entangle the fibers into a pattern of high density regions. After the web is dried a binder/soil release/cross-linking agent finish formulation is padded onto the web (i.e., saturation bonded) and the web is again dried by passing through a stack of drying cans. The resultant dried fabric has an added solid content of 10.6% by weight. The binder/-soil release/cross-linking agent finish formulation has the following composition: An acrylate emulsion binder sold by Rohm and Haas Co. as Rhophex TR 934; a synthetic resin cross-linking agent based on melamine formaldehyde known as Cymel 303 and sold by American Cyanamid Co.; a fluorochemical polymer soil release agent sold by Minnesota Mining and Manufacturing as Scotchban FC-829; isopropanol; diammonium phosphate; an anionic surfactant known as Deceresol OT special; an anti-foaming agent sold by Dow as Dow Anti-Foam Y-30; and water. Approximately 37 grains per square yard of binder/soil release/cross-linking agent finish formulation is applied. The fabric is dried at a temperature of 305° F. for 0.5 minutes to remove excessive water and cure the binder. The percent of dry solids on the resultant fabric is 10.61%.

The binder/soil release/cross-linking agent finish formulation of Example 1 is set forth in the following table:

TABLE 1

BINDER/SOIL RELEASE/CROSS-LINKING AGENT FINISH FORMULATION

| Name of Chemical | % Solids as Supp. | Wt. (Lb) as Mixed | % Own wt. of Bath as Mixed | % Dry Solids own wt. of Bath | % Dry Solids on Fabric @ 120% Wet Pick Up |
|---|---|---|---|---|---|
| Rhoplex TR934* | 44.5 | 757.3 | 18.16 | 8.08 | 9.7 |
| Cymel 303* | 100 | 10.4 | 0.25 | 0.25 | 0.3 |
| Scotchban FC-829 | 30 | 34.8 | 0.84 | 0.25 | 0.3 |
| Isopropanol | — | 10.4 | 0.25 | — | — |
| Diammonium Phosphate | 100 | 7.2 | 0.17 | 0.17 | 0.2 |
| Deceresol OT Special* | 70 | 4.6 | 0.11 | 0.08 | 0.1 |
| Dow Anti-Foam Y-30* | 30 | 1.2 | 0.027 | 0.008 | 0.01 |
| Water | — | 3344.3 | — | — | — |
| Total | | 4170 | 100 | 8.84 | 10.61 |

*Trademark

The above example illustrates the preparation of the fabric of the invention starting from a web of polyester fibers. However, the process of applying the binder/soil release/cross-linking agent finish formulation, may just as effectively be applied to a ready made fabric which contains at least 10% of polyester fibers.

Six samples of the fabric prepared in accordance with Example 1 were subjected to laundering in accordance with the standard method described hereinbefore. The rating results are as follows:

TABLE 2

SOIL RELEASE TEST RATING

| No. of Washes | Sample Code 1 | 2 | 3 | 4 | 5 | 6 |
|---|---|---|---|---|---|---|
| 0 | 3 | 3.5 | 5 | 5 | 5 | 5 |
| 3 | 3 | 3.5 | 4 | 5 | 5 | 5 |
| 5 | 3 | 3 | 5 | 4.5 | 4 | 4 |
| 7 | 3 | 3.5 | 4 | 4 | 4 | 4.5 |
| 10 | 2 | 2 | 4.5 | 4.5 | 4 | 4 |

In the above Table 2, samples 1 and 2 contained 0% soil release agent; samples 3 and 4 contained 0.5% by weight of soil release agent and samples 5 and 6 contained 0.3% by weight of soil release agent. Samples 1, 3 and 5 were Celanese polyester known as T-310 and samples 2, 4 and 6 were DuPont polyester known as D-145W.

It will be noted, from the above Table 2, that when the soil release agent is added via the binder/cross-linking agent system, a soil release durable through ten launderings is obtained, whereas when no soil release agent is added (Samples 1 and 2)the test rating after 10 washes is very poor.

In order to compare the fabric of the invention with a similar fabric, already containing binder, which has been post-treated with a fluorochemical soil release agent alone, said post-treated fabric was subjected to two launderings in accordance with the above described standard method, resulting in a rating of only 2.5. This indicated poor soil release durability after laundering for said post-treated sample.

TEST PROCEDURES

Comparative tests were conducted in order to compare the soil release properties of fabrics treated in accordance with the invention as compared to fabrics treated with a soil release agent and a binder but not with a cross-linking agent; and also with fabrics treated with a soil release agent and a cross-linking agent but not with a binder.

Polyester fabrics were treated with the following formulations, the figures given being the weight proportions of the components:

TABLE 3

FINISH FORMULATIONS

| CHEMICAL | Batch (In Weight Proportions) A | B | C |
|---|---|---|---|
| Acrylate Binder Rhoplex TR-934 | 33.3 | 33.33 | — |
| Cross-linking Agent based on Melamine Formaldehyde Cymel-303 | 0.46 | — | 0.46 |
| IPA 74% Isopropanol | 0.61 | — | 0.61 |
| DAP 10% Diammonium Phosphate | 3.06 | 3.06 | 3.06 |
| Anionic Surfactant Deceresol OT Special (25%) | 0.86 | 0.86 | 0.86 |
| Y-30 Dow Anti-Foam | 0.05 | 0.05 | 0.05 |
| Fluorochemical Soil Release Agent - Scotchban FC-829 | 1.50 | 1.50 | 1.50 |
| Water | 260.13 | 261.20 | 293.46 |

From the above Table 3, it will be noted that batch B omits the melamine formaldehyde cross-linking agent; and batch C omits the acrylate binder.

Specimens of 100% polyester fabric prepared in accordance with the method of Example 1 (except that the wet pick up was 200% of the above formulations) were treated with the above formulations A, B and C. Each specimen was first tested by the soil release:oily stain release method described hereinbefore in order to determine the soil release test rating with zero washes; (i.e., each specimen was immediately stained, washed once and the test rating determined). Thereafter, clean specimens of polyester fabric treated respectively with batches A, B and C were washed twice in an automatic washer in accordance with the washing procedure described hereinbefore. Thereafter the specimens were tested for soil release using the soil release:oily stain release method. This involves staining the specimens in accordance with the standard procedure, washing once and then determining the respective soil release test rating. The results are set forth in the following Table 4:

TABLE 4

SOIL RELEASE TEST RATING

| No. of Washes | Polyester Treated with Batch No. A | B (Melamine Formaldehyde Omitted) | C (Binder Omitted) |
|---|---|---|---|
| 0 | 5.0 | 4.7 | 4.6 |
| 2 | 4.7 | 3.2 | 3.5 |

From Table 4 it will be seen that all three specimens provide good soil release test ratings when initially subjected to the soil release:oily stain release method (i.e., there being 0 washes). However, after the specimens are subjected to two washes and then tested with the soil release:oily stain release method, the fabrics treated with batch B (in which the melamine formaldehyde cross-linking agent was omitted) and the fabric treated with batch C (in which the acrylate binder was omitted) provided soil release test ratings of 3.2 and 3.5 respectively which are somewhat low; whereas the fabric treated with batch A in full conformance with the present invention; provided an excellent soil release test rating of 4.7. This improvement of more than one point in the test rating of the fabric treated with batch A is very significant and clearly demonstrates the synergistic effect provided by the present invention; namely that both the cross-linking agent as well as the binder must be present together with the soil release agent in order to provide the superior results demonstrated by the present invention.

Although the fabric of the present invention is preferably used in connection with the facing sheets of mattress pads, nevertheless, the present fabric may be used for any purpose in connection with which good soil release properties are desirable.

The present invention is effective with respect to all textiles containing at least 10% by weight of polyester fibers. Thus, polyester/cotton blends, polyester/rayon blends and many other such blends may be effectively treated in accordance with the present invention.

We claim:

1. A fabric comprising at least 10% by weight of polyester fibers, said fabric being durably soil releasing on laundering, said fabric being finished with a soil release finish consisting essentially of a cured mixture of (A) a fluorochemical soil release agent; (B) an adhesive binder; and (C) a cross-linking agent.

2. An entangled fiber nonwoven fabric comprising at least 10% by weight of polyester fibers, which is durably soil releasing on laundering, said fabric being finished with a soil release finish consisting essentially of a cured mixture of (A) a fluorochemical soil release agent; (B) an acrylic emulsion adhesive binder; and (C) a cross-linking agent, component (A) varying between 0.2% and 0.6%, component (B) varying between 1% and 15%, and component (C) varying between 0.15% and 3.0% of the dry weight of the textile.

3. The fabric of claim 2, wherein the finish consists essentially of a cured mixture in percent by weight of said fabric of 0.2% to 0.4% of said soil release agent 6% to 12% of said adhesive binder and 0.2% to 1 % of melamine formaldehyde.

4. The fabric of claim 2 wherein the finish consists essentially of a cured mixture of about 0.3% fluorochemical polymer soil release agent, about 9.7% acrylic binder and about 0.3% melamine formaldehyde, based on the dry weight of the textile.

5. The fabric of claim 2 wherein the fabric comprises polyester/rayon.

6. The fabric of claim 3 wherein the fabric comprises 100% polyester.

7. A mattress pad comprising a quilted sheet of a fiber filler covered on both sides with facing sheets, at least one of said facing sheets comprising the fabric of claim 1.

8. A mattress pad comprising a quilted sheet of fiber filler covered on both sides with facing sheets, at least one of said facing sheets comprising the fabric of claim 2.

9. A process for making a fabric of which at least 10% by weight comprises polyester fibers, durably stain releasing on laundering, comprising treating said fabric with a soil release finishing composition consisting essentially of (A) a fluorochemical soil release agent, (B) a latex binder, and (C) a cross-linking agent followed by heating and curing.

10. A process for making an entangled fiber nonwoven fabric of which at least 10% by weight comprises polyester fibers, durably soil releasing on laundering, comprising treating said fabric with soil release finishing composition consisting essentially of (A) a fluorochemical soil release agent, (B) an acrylic latex binder, and (C) a cross-linking agent, component (A) varying between 0.2% and 0.6%, component (B) varying between 1% and 15% and component (C) varying between 0.15% and 3% of the dry weight of the textile, followed by heating and curing.

11. A process according to claim 10 wherein said finishing composition consists essentially of about 0.3% melamine formaldehyde, about 9.7% acrylic binder and about 0.3% fluorochemical polymer soil release agent, based on the dry weight of the textile.

12. The process of claim 10 wherein said finishing composition also includes an anti-foam agent and a surfactant.

13. The process of claim 10 in which the unfinished fabric is initially prepared by (a) forming a layer of overlapping intersecting fibers of which at least 10% by weight comprises polyester fibers; (b) supporting said layer on an apertured support member; and (c) directing essentially columnar jets of fluid directly against the surface of the supported layer opposite said apertured support member to rearrange the fibers into a regular repeating pattern of lightly entangled fiber regions.

* * * * *